US006131227A

United States Patent [19]

Rief et al.

[11] Patent Number: 6,131,227

[45] Date of Patent: Oct. 17, 2000

[54] SUCTION REGULATING SKIRT FOR AUTOMATED SWIMMING POOL CLEANER HEADS

[75] Inventors: Dieter J. Rief, Santa Rosa, Calif.; Hans Raines Schlitzer, Krugersdorp, South Africa

[73] Assignee: Poolvergnuegen, Santa Rosa, Calif.

[21] Appl. No.: 09/316,846

[22] Filed: May 21, 1999

Related U.S. Application Data

[60] Provisional application No. 60/106,437, Oct. 30, 1998.

[51] Int. Cl.[7] ..... E04H 4/16

[52] U.S. Cl. ..... 15/1.7; 15/418; 15/419

[58] Field of Search ..... 15/1.7, 418, 419

[56] References Cited

U.S. PATENT DOCUMENTS 2,846,711 8/1958 Brace ..... 15/418 X 3,019,462 2/1962 Nash et al. ..... 15/1.7

*Primary Examiner*—Mark Spisich

*Attorney, Agent, or Firm*—Jansson, Shupe, Bridge & Munger, Ltd.

[57] ABSTRACT

An improved skirt for use with an automatic or robotic pool cleaner head comprising at least one or a row of double-hinged flaps, each of the flaps comprising a receiving member affixed to the pool cleaner head, an upper articulating member pivotally coupled to the receiving member, and a lower articulating member pivotally coupled to the upper articulating member. The pivotally connected members form upper and lower hinges which allow free radial movement upward to, but not beyond, the bottom surface of the pool cleaning head, and further allow the cleaning head to navigate uneven surfaces or pieces of debris while maintaining effective suction.

12 Claims, 6 Drawing Sheets

SUCTION REGULATING SKIRT FOR AUTOMATED SWIMMING POOL CLEANER HEADS

This application claims the benefit of U.S. provisional application Ser. No. 60/106,437, filed Oct. 30, 1998.

BACKGROUND OF THE INVENTION

1. Field of the Invention

The present invention relates generally automatic swimming pool cleaners, and more particularly to self-adjusting suction regulating flaps forming a skirt that defines and contains the plenum chamber of water beneath the cleaning head of an automatic swimming pool cleaner, so that the water may be passed through the cleaning head to a water filtration system.

2. Description of the Prior Art

Among the conveniences offered in contemporary technology are automated or robotic pool cleaning systems. The function of such devices is to clean the submerged surfaces of a swimming pool or fluid tank, to pick up and transport dirty water to a filtering system, and to do so with minimal expenditure of human time and effort. Pool and fluid tank cleaning robots are typically of two general kinds: fluid powered and electric. Such devices are further classified according to whether they are powered by vacuum suction or fluid pressure. Ultimately, however, virtually all fluid suction and pressure driven systems draw water through the cleaning head by subjecting a defined volume of fluid to suction. Typically the fluid is passed to a pool filtration system and returned to the pool cleaned and/or otherwise treated.

Critical to the proper functioning and optimum efficiency of swimming pool cleaners of this type is a skirt bordering and extending downwardly from the inferior portion of the body of the cleaning head. There are several purposes for such skirts, including: (1) to regulate the suction under the pool cleaner head; (2) to maintain effective fluid suction within the plenum chambers of water defined by the cleaning head, the submerged pool surface, and the skirt; (3) to scrape and dislodge loose debris; (4) to accommodate uneven surfaces, terrain and pieces of debris; and (5) to provide a fluid suction force sufficiently powerful to keep the head pressed against the submerged surface and to allow the cleaning head to travel up and across submerged steeply inclined and vertical surfaces.

Prior art skirts typically comprise either a continuous elastomer band fabricated from a suitably durable elastic and resilient material or a plurality of downwardly projecting bristles. While such skirts generally accomplish the first three objectives outlined above, no design known to date provides substantially uncompromised fluid suction on the plenum chamber as the cleaning head passes over uneven surfaces or large pieces of debris, while also allowing large pieces of debris to pass underneath the cleaning head to be further passed through the head and delivered to the filtration system.

SUMMARY OF THE INVENTION

The present invention is an improved skirt for defining and containing the plenum chamber volume of water created beneath a suction or pressure driven automatic or robotic swimming pool cleaning head. The skirt of the present invention provides increased cleaning head efficiency by automatically adjusting to uneven terrain and submerged pieces of debris to maintain the strength of the fluid suction forces to which the plenum chamber volume of water is subjected. The skirt comprises one or a plurality of suction regulating flaps in a segmented row, each flap of which comprises a double hinged component projecting downwardly from the cleaning head housing and having a fully extended configuration and a flexed or articulated configuration. Individual flaps comprise an upper articulating member having proximal and distal ends and a middle segment which is gently curved outward relative to the plenum chamber. The upper articulating member is pivotally connected to the bottom surface of the pool cleaning head so as to form a hinge. The hinge may be integral with the proximal end of the upper articulating member or may be formed through a pivotal connection of an enlargement at the proximal end to a receiving member attached to the bottom surface of the cleaning head. When coupled, the upper articulating member and receiving member form an upper hinge.

The suction flaps further comprise a lower articulating member that curves gently outwardly from the plenum chamber. The lower articulating member is connected to the upper articulating member with a hinge having an axis preferably parallel to the axis of the first hinge. In the preferred embodiment, the lower articulating member has an integrally formed aperture for pivotally receiving the a distal enlargement of the upper articulating member. When coupled, the lower and upper articulating members form a lower hinge or joint. Alternatively, the hinge is integral with both the upper and lower articulating members, as in a living hinge. In either case, the suction flaps are double hinged. The coupled segments are so configured as to allow free radial movement upward to, but not beyond, the bottom surface of the pool cleaning head. Movement backwards toward the plenum chamber is prohibited beyond the fully extended configuration due to physical stops. Any interfering movements of individual segments are precluded by a slight separation of individual flaps. Thus, optimal suction is maintained while providing the advantages of a rigid but hinged skirt.

In operation the self-adjusting flaps adjust themselves to different suctions and water flows. The fluid suction pulls the flaps down and away from the bottom surface of the cleaning head, but when uneven surfaces or pieces of debris are encountered, the flaps articulate at either or both the upper and lower hinges in an amount necessary to navigate the terrain or to negotiate, pull in, or pass the debris. Effective fluid suction is maintained throughout.

DETAILED DESCRIPTION OF A PREFERRED EMBODIMENT

Figure 1:
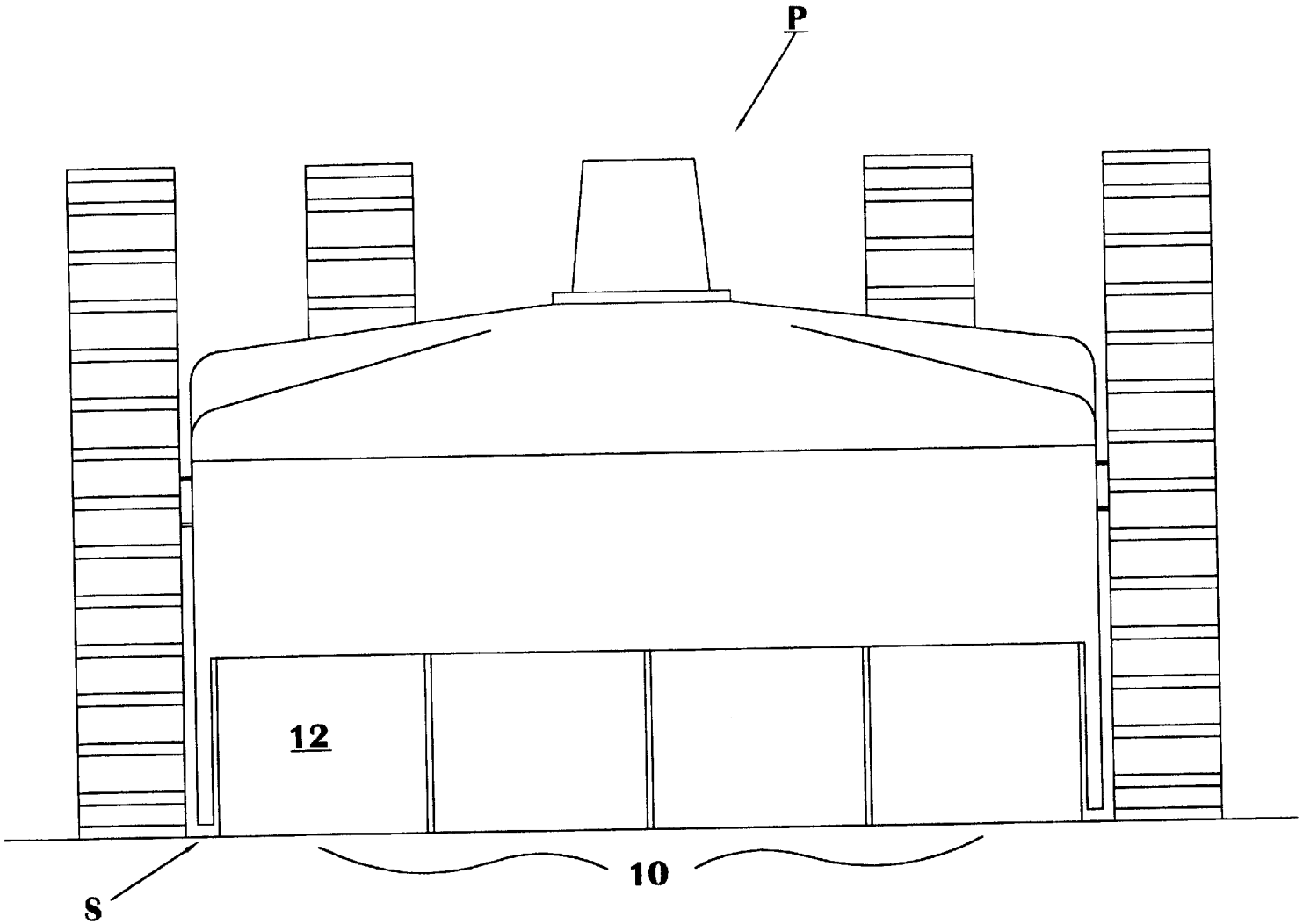
FIG. 1 is a top view of the skirt for an automatic swimming pool cleaning head of the present invention, showing a row of suction regulating flaps in operation with a robotic cleaning head shown in front view.
Figure 2:
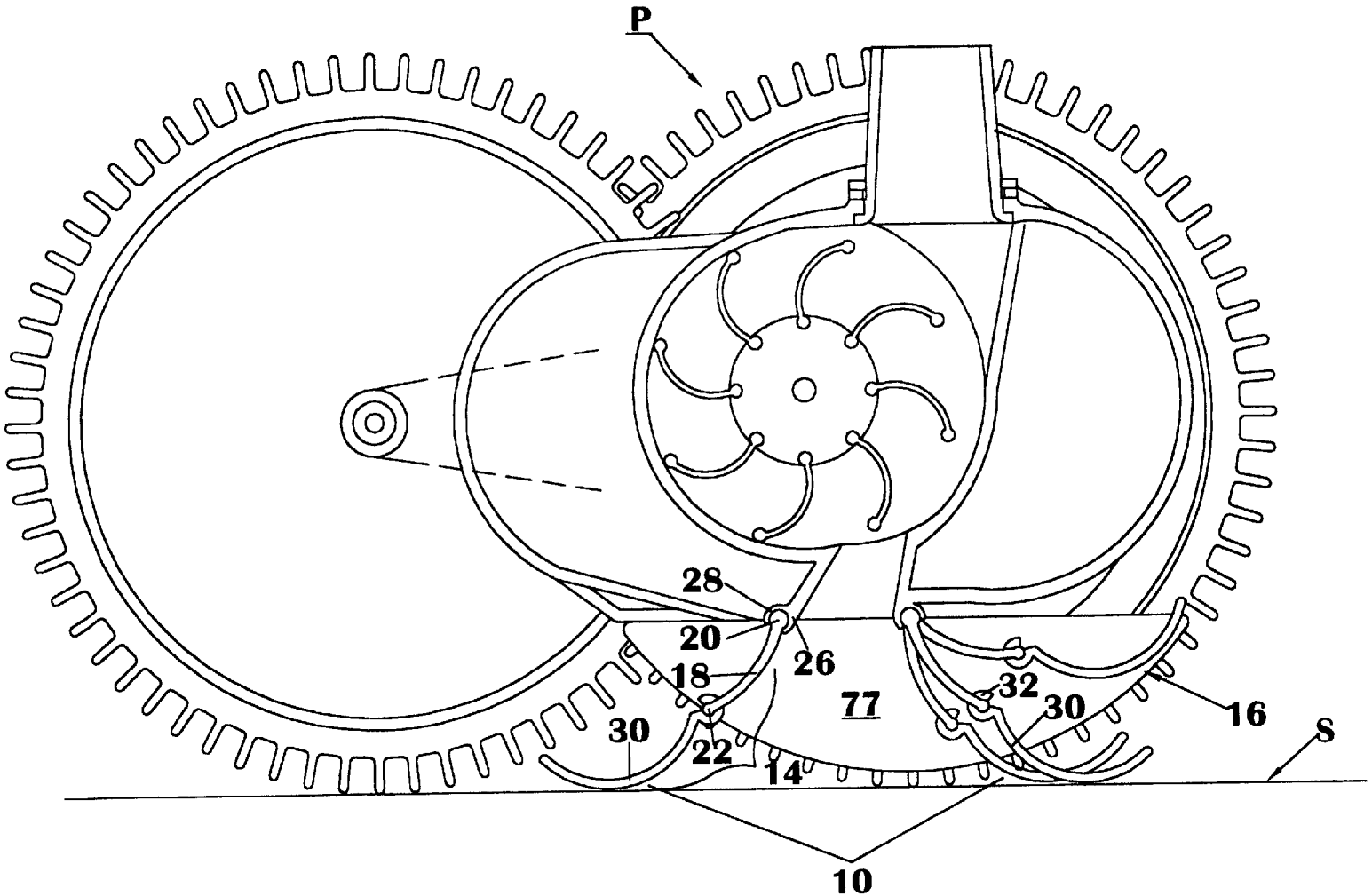
FIG. 2 is a side elevation view of the skirt of the present invention, shown in operation with the same pool cleaning device depicted in FIG. 1 shown in cross section.

FIG. 1 is a front view of the skirt for an automatic swimming pool cleaning head of the present invention 10, showing a row of suction regulating flaps in operation on a pool surface (indicated S) with a robotic cleaning head (denominated generally as P). FIG. 2 is a side elevation view of the suction regulating flaps shown in operation with the same pool cleaning device depicted in FIG. 1 shown in cross section. As can be seen, in the most general terms a pool cleaner of the type depicted typically consists of a housing, a plurality of drive wheels rotatably connected to axles extending from the housing, a fluid powered turbine, a fluid entry port, and a water exit port for connection to a suction hose.

The plenum chamber 77 upon which the cleaning head is working at any given time is defined by the inferior portion of the lower body half of the cleaning head housing and the assembly of vacuum regulating flaps 10. In assembly, the plurality of flaps effectively defines a segmented row which comprise a front and back boundary wall defining the plenum chamber of fluid immediately under the cleaning head turbine inlet. This kind of boundary is typically referred to as a skirt.

Each suction regulating flap comprises a double hinged component projecting downwardly from the cleaning head housing and having a fully extended configuration 14 and a flexed configuration 16. The flaps appear generally rectangular when viewed from the front or rear of the cleaner head, and generally J-shaped when viewed from the side (reverse J-shaped when viewed from the opposite side).

Individual suction regulating flaps comprise an upper articulating member 18 having a proximal transverse cylindrical enlargement 20, a distal transverse cylindrical enlargement 22, and a middle segment which is gently curved outward relative to the plenum chamber 77. The upper articulating member 18 is pivotally connected to the bottom surface of the pool cleaning head P via a receiving member 26 having a transverse cylindrical aperture 28 for holding the proximal enlargement 20 of the upper articulating member 18. The receiving member 26 may be integrally formed in the pool head cleaning body (as is shown in FIG. 1), or an independent member affixed to the cleaning head in a number of ways. When coupled, the upper articulating member 18 and receiving member 26 form an upper joint or hinge. There are number of means whereby the upper articulating member may be coupled to the receiving member. Preferably, however, the upper articulating member 18 is coupled with the receiving member 26 either by snapping or by laterally sliding the enlarged proximal end 20 of the upper articulating member 18 into the transverse cylindrical aperture 28 of the receiving member 26.

The suction flaps further comprise a lower articulating member 30, which preferably curves gently outward from the plenum chamber 77 when in the extended configuration 14. The lower articulating member has an integrally formed transverse cylindrical aperture 32 having an opening for pivotally receiving the distal cylindrical enlargement 22 of the upper articulating member 18. When coupled, the lower and upper articulating members form a lower hinge or joint. Thus, the suction flaps are double hinged. Preferably, the enlarged distal end 22 of the upper articulating member 18 snaps snugly into the integrally formed transverse cylindrical aperture 32 of the lower articulating member 30.

The proximal enlargement 20 and the transverse cylindrical aperture 28, as well as the distal enlargement 22 and the integrally formed transverse aperture 32 of the lower articulating member 30, are so configured as to allow free radial movement upward to, but not beyond, the bottom surface of the pool cleaning head. Movement backwards toward the plenum chamber 77 prohibited beyond the fully extended configuration 14 due to physical stops. There is, therefore, no risk of drawing the flaps into the turbine or of collapsing the flaps inward with no means of returning them to the fully extended configuration.

Figure 3:
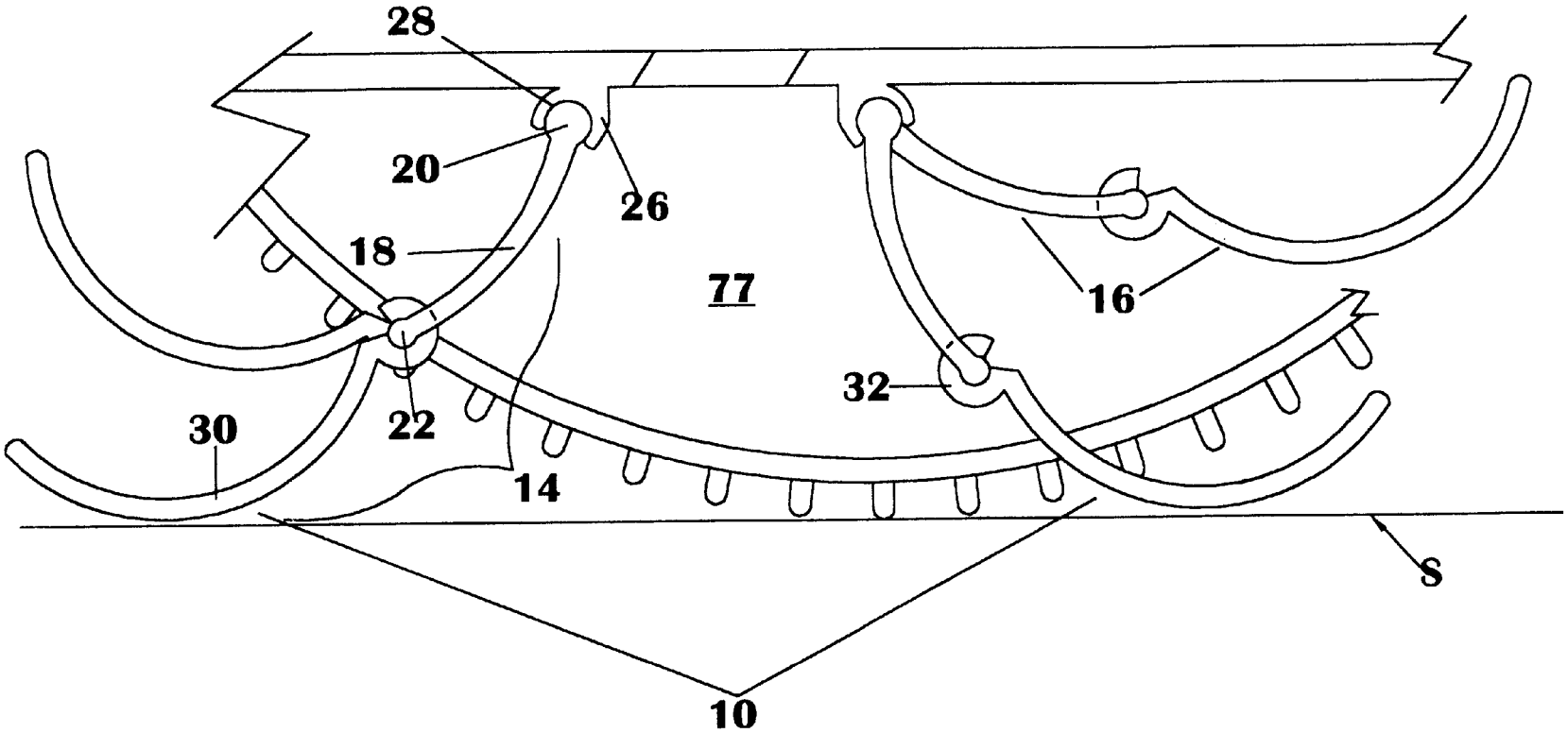
FIG. 3 is a side elevation view showing details of the operational radial movement of the suction regulating flaps shown in FIG. 2.

FIG. 3 is a side elevation view showing details of the operational radial movement of the suction regulating flaps. During operation, the self-adjusting vacuum regulating flaps adjust themselves to different suction pressures and water flows. The fluid suction pulls the flaps down and away from the bottom surface of the cleaning head. When uneven surfaces or pieces of debris are encountered, the flaps articulate at both the upper and lower hinges only in an amount necessary to navigate the terrain or to negotiate, pull in, or pass the debris. Thus, fluid suction is maintained throughout.

Figure 4A:
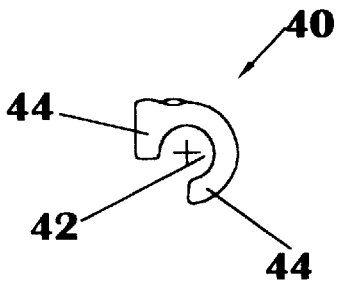
FIG. 4*a* is side elevation view showing a first embodiment of the receiving member forming an upper hinge for a single suction flap.
Figure 4B:
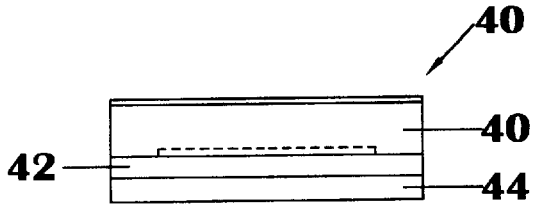
FIG. 4*b* is a front view of the receiving member of FIG. 4*a;*

FIGS. 4*a* and 4*b* are side elevation views and front views, respectively, of the receiving member forming an upper hinge for a single suction flap. Said receiving member 40 comprises an inverted transverse cylindrically-shaped aperture 42 formed by a curved first arm 44 and a second curved arm 46, longer than the first curved arm and curved so as to form an incompletely closed circle with the first curved arm when viewed in profile.

Figure 5A:
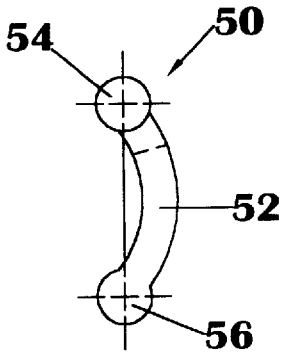
FIG. 5*a* is a side elevation view of a first embodiment of the upper articulating member of the skirt present invention, suitable for coupling with the receiving member shown in FIGS. 4*a* and 4*b;*
Figure 5B:
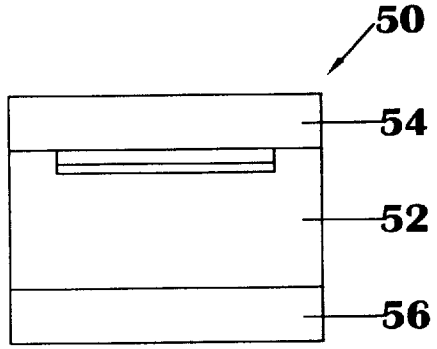
FIG. 5*b* is a front view of the upper articulating member of FIG. 5*a;*

FIGS. 5*a* and 5*b* are a side elevation view and front view, respectively, of the upper articulating member 50 of the suction flap of the present invention. Said upper articulating member comprises a gently curved middle segment 52, an enlarged upper or proximal end 54, an enlarged distal or lower end 56. The upper end 54 is fitted to pivotally couple and form a hinge with the receiving member shown in FIGS. 4*a* and 4*b*.

Figure 6A:
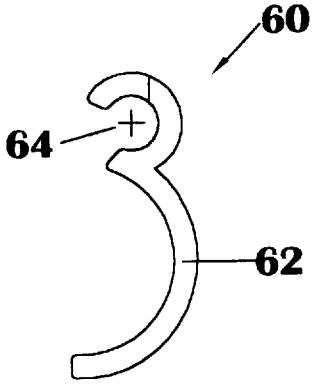
FIG. 6*a* is a side elevation view of a first embodiment of the lower articulating member of the skirt of the present invention, suitable for coupling with the upper articulating member shown in FIGS. 5*a* and 5*b;*
Figure 6B:
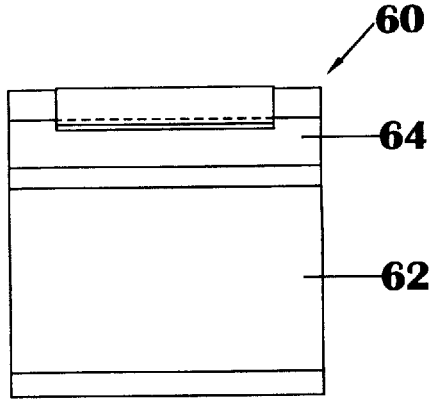
FIG. 6*b* is a front view of the lower articulating member of FIG. 6*a.*

FIGS. 6*a* and 6*b* are a side elevation and front view, respectively, of the lower articulating member 60 of the suction flaps of the present invention. Said lower articulating member comprises a curved lower portion 62, which rests on the submerged surface being cleaned when the flaps are extended, and an integrally formed transverse cylindrical aperture 64 at its upper end having an opening for pivotally receiving the distal cylindrical enlargement 56 of the upper articulating member 50.

Figure 7A:
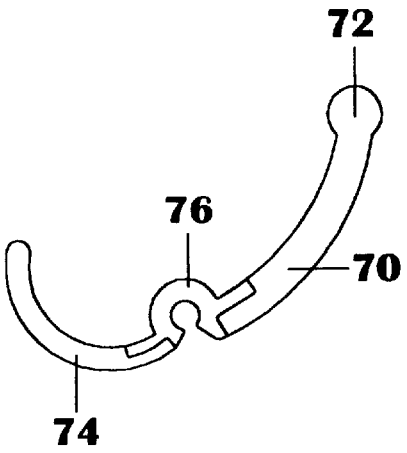
FIG. 7*a* is a side elevation view of a second embodiment of the skirt for an automatic swimming pool cleaner head of the present invention, illustrating upper and lower articulating members connected by a hinge integral to both of the upper and lower articulating members, wherein the hinge is fabricated from a flexible polymer and the upper and lower articulating members are each fabricated from a rigid material, and wherein the skirt is in an articulated configuration.
Figure 7B:
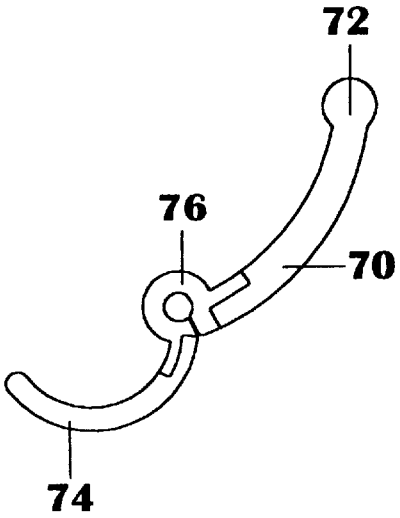
FIG. 7*b* is a side elevation view of the skirt of 7*a*, showing the skirt in a fully extended configuration.

The skirt may be fabricated from a number of suitable materials or combinations of materials. FIG. 7*a* is a side elevation view of a second embodiment of the skirt of the present invention. This embodiment comprises an upper articulating member having an enlarged proximal end 72 for pivotally coupling with a receiving member as described above, a lower articulating member 74, and a hinge 76 integral to each of the upper and lower articulating members. In this embodiment, the hinge 76 is preferably a living hinge fabricated from a flexible polymer and the upper 70 and lower 74 articulating members are each fabricated from a rigid material. FIG. 7*a* shows the skirt in an articulated configuration. FIG. 7*b* is a side elevation view of the skirt of 7*a*, showing the skirt in a fully extended configuration.

Figure 8A:
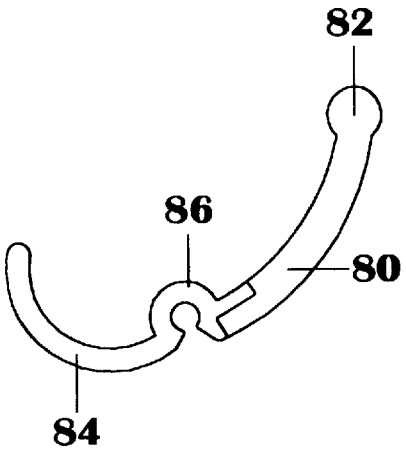
FIG. 8*a* is a side elevation view of a third embodiment of the present invention, illustrating upper and lower articulating members connected by a hinge integral to both of the upper and lower articulating members, wherein the hinge and lower articulating member are fabricated from a flexible polymer and the upper articulating member is fabricated from a rigid material, and wherein the skirt is in an articulated configuration.
Figure 8B:
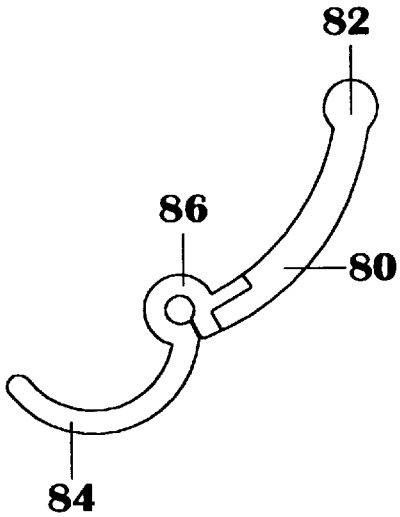
FIG. 8*b* is a side elevation view of the skirt of 8*a*, showing the skirt in a fully extended configuration.

FIG. 8*a* is a side elevation view of a third embodiment of the present invention, illustrating an upper articulating member 80 having an enlarged proximal end 82 for pivotally coupling with a receiving member, a lower articulating member 84, and a hinge 86 integral to each of the upper and lower articulating members. In this embodiment, the hinge 86 and lower articulating member 84 are fabricated from a flexible polymer, and the upper articulating member 82 is fabricated from a rigid material. FIG. 8*a* shows the skirt is in an articulated configuration. FIG. 8*b* shows the skirt in a fully extended configuration.

Figure 9A:
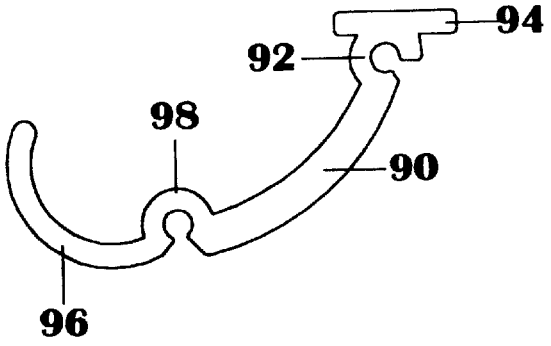
FIG. 9*a* is a side elevation view of a fourth embodiment of the present invention, showing the upper articulating member have an integrally formed hinge and receiving member at its proximal end, and further illustrating upper and lower articulating members connected by a hinge integral to both of the upper and lower articulating members, wherein the entire skirt fabricated from a flexible polymer, and wherein the skirt is in an articulated configuration.

FIG. 9*a* is a side elevation view of a fourth embodiment of the present invention. In this embodiment, the upper articulating member 90 has an integrally formed hinge 92 and an integrally formed connecting member 94 at its proximal end for attachment to the bottom surface of an automatic pool cleaning head. As with the second and third embodiments, the upper articulating member 90 and lower articulating member 96 are connected by a hinge 98 integral to each of the upper and lower articulating members. In this embodiment the entire skirt is fabricated from a flexible polymer. The skirt is shown in an articulated configuration in FIG. 9*a* and in a fully extended configuration in 9*b*.

Figure 9B:
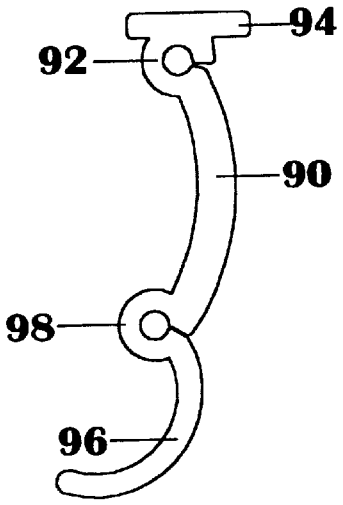
FIG. 9*b* is a side elevation view of the skirt of 9*a*, showing the skirt in a fully extended configuration.
Figure 10A:
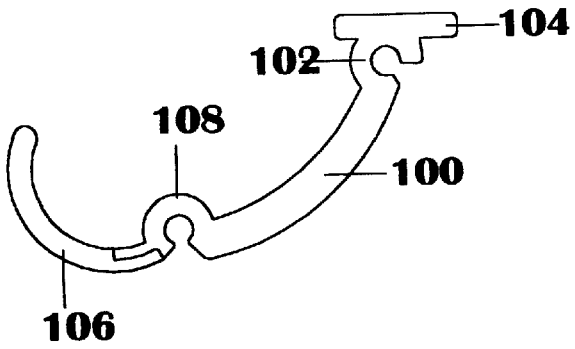
FIG. 10*a* is a side elevation view of a fifth embodiment of the present invention, showing the same skirt as in FIGS. 9*a* and 9*b*, but having a lower articulating member fabricated from a rigid material and an upper articulating member having an integral distal and proximal hinges and an integral proximal coupling member fabricated from flexible polymer, and wherein the skirt is in an articulated configuration.
Figure 10B:
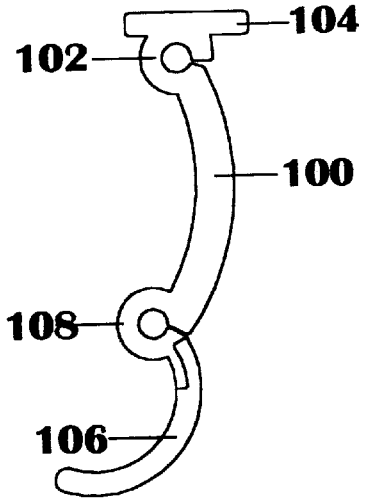
FIG. 10*b* is a side elevation view of the skirt of FIG. 10*a*, showing the skirt in a fully extended configuration.

FIG. 10*a* is a side elevation view of a fifth embodiment of the present invention, showing the same skirt as in FIGS. 9*a* and 9*b*, but with an upper articulating member 100 having an integrally formed hinge 102 and coupling member 104 fabricated from a rigid material, and a lower articulating member 106 fabricated from flexible polymer, and a hinge 108 integral with and connecting the lower and upper articulating members formed of a flexible polymer. FIG. 10*a* shows the skirt in an articulated configuration, and FIG. 10*b* shows the skirt of FIG. 10*a* in a fully extended configuration.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A skirt for an automatic pool cleaning head, comprising:

at least one flap member including an upper articulating member, said upper articulating member having a distal and proximal end, and having a substantially rectangular shape when viewed from the front and back;

a first hinge having a first axis connecting and interposed between said upper articulating member and the pool cleaning head so as to allow radial motion relative to said pool cleaning head;

a lower articulating member, said lower articulating member having a distal and a proximal end and a substantially rectangular shape when viewed from the front and back; and a second hinge having a second hinge axis parallel to said first hinge axis and connecting and interposed between said lower articulating member and said upper articulating member.

2. The skirt for an automatic pool cleaner head of claim 1, wherein said skirt has a fully extended configuration and an articulated configuration.

3. The skirt for an automatic pool cleaner head of claim 1, wherein said upper articulating member has a transverse cylindrical enlargement at its proximal end, a transverse cylindrical enlargement at its distal end, and a middle portion between said proximal and distal transverse cylindrical enlargements.

4. The skirt for an automatic pool cleaner head of claim 3 including a receiving member having a transverse cylindrical aperture for pivotally coupling with the proximal transverse cylindrical enlargement of said upper articulating member.

5. The skirt for an automatic pool cleaner head of claim 4 wherein said lower articulating member has an integrally formed transverse cylindrical aperture for pivotally coupling with the distal transverse cylindrical enlargement of said upper articulating member.

6. The skirt for an automatic pool cleaner head of claim 1 wherein said upper articulating member when viewed in profile curves generally outward relative to the center of the pool cleaning head.

7. The skirt for an automatic pool cleaner head of claim 1 wherein said lower articulating member when viewed in profiles curves generally outward relative to the center of the pool cleaning head.

8. The skirt of claim 1 wherein said second hinge is integrally formed with each of said upper and lower articulating members and wherein said second hinge is fabricated of a flexible polymer and said upper and lower articulating members are fabricated from a rigid material.

9. The skirt of claim 1 wherein said second hinge is integrally formed with each of said upper and lower articulating members and wherein said second hinge and said lower articulating member are fabricated of a flexible polymer and said upper articulating member is fabricated from a rigid material.

10. The skirt of claim 1 wherein said first hinge is integrally formed with a receiving member and said upper articulating member, said second hinge is integrally formed with each of said upper and lower articulating members, and wherein said hinged skirt is entirely fabricated from a flexible polymer.

11. The skirt of claim 1 wherein said first hinge is integrally formed with a receiving member and said upper articulating member, said second hinge is integrally formed with each of said upper and lower articulating members, said lower articulating member is fabricated from a rigid material, and wherein said receiving member, said upper articulating member, and said first hinge are fabricated from a flexible polymer.

12. A skirt for an automated pool cleaner head comprising:

a receiving member integrally connected to the bottom surface of an automatic pool cleaning head and having a transverse cylindrical aperture;

at least one of self-adjusting hinged flaps forming a boundary around a plenum volume of water subjected to vacuum suction, each of said flaps having a fully extended configuration; an articulated configuration; an upper articulating member having a proximal and distal end, a transverse cylindrical enlargement at its proximal end pivotally coupled with said receiving member, a transverse cylindrical enlargement at its distal end, and a middle portion between said proximal and distal enlargements; and a lower articulating member which curves gently outward from the center of the pool cleaner head in the extended configuration and having an integrally formed transverse cylindrical aperture for pivotally coupling with the distal cylindrical enlargement of said upper articulating member.

* * * * *